US007815791B2

(12) United States Patent
Keusenkothen

(10) Patent No.: US 7,815,791 B2
(45) Date of Patent: Oct. 19, 2010

(54) PROCESS AND APPARATUS FOR USING STEAM CRACKED TAR AS STEAM CRACKER FEED

(75) Inventor: Paul F. Keusenkothen, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 392 days.

(21) Appl. No.: 12/112,704

(22) Filed: Apr. 30, 2008

(65) Prior Publication Data

US 2009/0272671 A1 Nov. 5, 2009

(51) Int. Cl.
*C10C 1/20* (2006.01)

(52) U.S. Cl. ..... 208/67; 208/49; 208/68; 208/106; 208/130; 208/132

(58) Field of Classification Search ..... 208/49, 208/67–68, 106, 125, 128, 130–132
See application file for complete search history.

(56) References Cited

U.S. PATENT DOCUMENTS 3,310,484 A 3/1967 Mason et al.
3,384,448 A 5/1968 Mason et al.
3,691,058 A 9/1972 Hamner et al.
4,233,138 A * 11/1980 Rollmann et al. ..... 208/106
4,257,871 A 3/1981 Wernicke et al.
4,310,409 A 1/1982 Wernicke et al.
6,149,800 A 11/2000 Iaccino et al.
6,190,533 B1 2/2001 Bradow et al.
6,210,561 B1 4/2001 Bradow et al.
6,303,842 B1 10/2001 Bridges et al.
2007/0090019 A1 * 4/2007 Keusenkothen et al. ..... 208/106

OTHER PUBLICATIONS

A.G. Goossens, Hydrocracker Feeds Olefin Unit, Hydrocarbon Processing, Nov. 1986, Vo. 65, No. 11, pp. 84-86.
U.S. Appl. No. 12/023,204, filed Jan. 31, 2008, entitled Process and Apparatus for Upgrading Steam Cracked Tar, Inventor(s): John D. Y. Ou, et al.
U.S. Appl. No. 12/099,971 filed Apr. 9, 2008, entitled Process and Apparatus for Upgrading Steam Cracked Tar Using Steam, Inventor(s): John D. Y. Ou, et al.

* cited by examiner

*Primary Examiner*—Robert J Hill, Jr.
*Assistant Examiner*—Brian McCaig

(57) ABSTRACT

A process and apparatus are provided for steam cracking heavy feeds, including steam cracked tars. The invention heats a steam cracked tar feed to provide a depolymerized steam cracked tar containing lower boiling molecules than the steam cracked tar feed, hydrogenates the depolymerized steam cracked tar using a hydrogenating catalyst, e.g., a downward flow fixed bed hydrotreater, to provide a hydrogenated steam cracked tar. At least a portion of the hydrogenated steam cracked tar is steam cracked in a steam cracking furnace comprising a convection zone and a radiant zone.

17 Claims, 1 Drawing Sheet

PROCESS AND APPARATUS FOR USING STEAM CRACKED TAR AS STEAM CRACKER FEED

FIELD OF THE INVENTION

The present invention relates to the cracking of hydrocarbons, especially with feeds containing relatively non-volatile hydrocarbons, which results in the formation of steam cracked tar. More particularly, the present invention relates to a cracking process and apparatus which utilizes steam cracked tar as feed to the steam cracker. The resulting steam cracked products include an improved low sulfur vacuum tower bottoms stream.

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis (or steam cracking) furnace that has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products, including olefins, leave the pyrolysis furnace for further downstream processing.

Pyrolysis involves heating the feedstock sufficiently to cause thermal decomposition of the larger molecules. The pyrolysis process, however, produces molecules that tend to combine to form high molecular weight materials known as tar. Tar is a high-boiling point, viscous, reactive material that can foul equipment under certain conditions. In general, feedstocks containing higher boiling materials tend to produce greater quantities of tar.

Conventional steam cracking systems have been effective for cracking high-quality feedstock which contains a large fraction of light volatile hydrocarbons, such as ethane, and naphtha. However, steam cracking economics sometimes favor cracking lower cost heavy feedstocks such as, by way of non-limiting examples, gas oil, crude oil and atmospheric residue. Gas oil, crude oil and atmospheric residue often contain high molecular weight, non-volatile components with boiling points in excess of about 590° C. (1100° F.) otherwise known as resids.

Cracking heavier feeds, such as residues, kerosenes and gas oils, produces large amounts of tar, which typically contains high-boiling and/or non-volatile components including paraffin-insoluble compounds, such as pentane-insoluble (PI) compounds or heptane-insoluble (HI) compounds, which are molecules of high molecular weight with multi-ring structures, e.g., asphaltenes. These materials reduce the economic value of tar by rendering it highly viscous and less compatible for mixing with highly paraffinic streams, inducing precipitation of the paraffin-insoluble components from the resulting mixture.

Various methods are known in the art to treat tars produced from steam cracking.

U.S. Pat. No. 3,691,058, incorporated herein by reference in its entirety, discloses depolymerization and subsequent hydrocracking to break down steam cracked tars from gas oils containing condensed ring aromatics into single-ring aromatics.

U.S. Pat. No. 3,310,484, incorporated herein by reference in its entirety, discloses thermal depolymerization in methylnaphthalene of asphaltenes obtained from a crude oil.

U.S. Pat. No. 3,384,448, incorporated herein by reference in its entirety, teaches thermal depolymerization of a crude oil and vanadium recovery therefrom.

U.S. Pat. No. 4,310,409, incorporated herein by reference in its entirety, discloses hydrogenating distillates and deasphalted fractions, e.g., gas oil, vacuum gas oil, deasphalted atmospheric, vacuum residue, visbreaker or coker distillates. The heavy hydrogenated fraction is subjected to thermal cracking.

U.S. Pat. No. 4,257,871, incorporated herein by reference in its entirety, teaches preparation of olefins from deasphalted vacuum residue by blending the asphalt-depleted product with a lighter fraction, e.g., vacuum gas oil, and hydrogenating the blend, followed by thermal cracking.

U.S. Pat. No. 6,149,800, incorporated herein by reference in its entirety, teaches preparation of olefins by hydroprocessing a feed such as deasphalted oil using a countercurrent hydrogen-containing treatment, followed by thermal cracking in a steam cracker.

U.S. Pat. No. 6,190,533, incorporated herein by reference in its entirety, discloses converting hydrocarbons such as visbreaker oil or deasphalted oil into steam cracked products by hydrotreating to remove organic sulfur and/or nitrogen compounds, and then passing to a steam cracking zone.

U.S. Pat. No. 6,210,561, incorporated herein by reference in its entirety, discloses steam cracking a visbreaker oil or deasphalted oil which has been hydrotreated with aromatics saturation.

U.S. Pat. No. 6,303,842, incorporated herein by reference in its entirety, discloses the production of olefins by thermally steam cracking residua feedstocks. Feedstock such as a petroleum residuum can be hydrotreated, if necessary, and subjected to deasphalting prior to hydrotreatment, if required.

*Hydrocarbon Processing,* 65(11), pp. 84-86, November, 1986, discloses hydrocracking low grade vacuum-flashed distillates to provide hydrogenated residue (hydrowax) to provide a feed for an ethylene plant.

U.S. application Ser. No. 12/023,204, filed Jan. 31, 2008, incorporated herein by reference in its entirety, discloses upgrading steam cracker tar by heating from below 300° C. to a temperature above 300° C. for a time sufficient to convert at least a portion of the steam cracked tar to lower boiling molecules.

U.S. application Ser. No. 12/099,971, filed Apr. 9, 2008, incorporated herein by reference in its entirety, discloses upgrading steam cracker tar by heating from below 300° C. to a temperature above 300° C. in the presence of steam and for a time sufficient to convert at least a portion of the steam cracked tar to lower boiling molecules.

It would be desirable to provide an apparatus and process to convert steam cracker tar to more valuable, lower boiling materials, which can be used as a steam cracker feed, while minimizing the production of unwanted steam cracked by-products. Moreover, it would be especially desirable to provide a steam cracker feed derived from steam cracker tar which is substantially reduced in tar asphaltenes or other polymers that can undergo high conversion catalytic hydrogenating (greater than about 5 wt. % conversion) while minimizing fouling of the hydrogenating catalyst.

SUMMARY OF THE INVENTION

It has now been found that a steam cracked tar feed can be used as the feed to a steam cracker by 1) heating a steam cracked tar feed to provide, e.g., by visbreaking, a depolymerized steam cracked tar containing lower boiling molecules than the steam cracked tar feed; 2) hydrogenating the depolymerized steam cracked tar using a hydrogenating catalyst to provide a hydrogenated steam cracked tar; and 3) steam cracking at least a portion of the hydrogenated steam cracked tar in a steam cracking furnace comprising a convection zone and a radiant zone.

In one aspect, the present invention relates to a process for steam cracking a steam cracked tar that comprises: a) heating a steam cracked tar feed from below 300° C. to a temperature above 300° C. for a time sufficient to provide a depolymerized steam cracked tar containing lower boiling molecules than the steam cracked tar feed (e.g., the depolymerized steam cracked tar having a lower initial boiling point than the steam cracked tar feed); b) hydrogenating the depolymerized steam cracked tar with a hydrogenating catalyst in the presence of hydrogen under hydrogenating conditions in a hydrogenation zone to provide a hydrogenated mixture comprising hydrogenated steam cracked tar; and c) steam cracking at least a portion of the hydrogenated steam cracked tar in a steam cracking furnace comprising a convection section and a radiant section. Steps a) and b) can be carried out in the same vessel or in separate vessels.

In an embodiment of this aspect, the process further comprises treating the hydrogenated mixture by at least one of vacuum distillation separation, and flash separation to remove a bottoms fraction and provide, from the remaining fraction, a portion of the hydrogenated steam cracked tar to be steam cracked.

In another embodiment of this aspect, the process of the invention further comprises: stabilizing the depolymerized steam cracked tar by contacting with a hydrogen donor to react with reactive styrene olefinic bonds and/or free radicals of the depolymerized steam cracked tar to provide i) stabilized depolymerized steam cracked tar containing stable intermediates and ii) gaseous products. The hydrogen donor can be selected from the group consisting of wild naphtha, naphthenic naphtha, isoparaffinic naphtha, and hydrotreated gas oil.

In yet another embodiment of this aspect of the invention, the process further comprises: separating the gaseous products from the stabilized depolymerized steam cracked tar prior to the hydrogenating step. The gaseous products can be separated as an overhead.

In still yet another embodiment of this aspect, the steam cracked tar feed is obtained by steam cracking a hydrocarbon feed selected from the group consisting of whole crudes, deasphalted crudes, resids, deasphalted atmospheric resids, condensates, raffinates, virgin naphthas, hydrotreated naphthas, cracked naphthas, virgin gas oils, hydrotreated gas oils, and cracked gas oils.

In yet still another embodiment of this aspect, the steam cracked tar feed has a hydrogen content of less than 11 wt. % hydrogen, and the hydrogenated steam cracked tar has a hydrogen content of greater than 11 wt. % hydrogen. Typically, the hydrotreated steam cracked tar feed can have a hydrogen content greater than about 12 wt. % hydrogen, or even greater than about 13 wt. % hydrogen. Hydrogen content can be measured by any suitable process, e.g., as set out in ASTM D 5291, "Standard Test Methods for Instrumental Determination of Carbon, Hydrogen, and Nitrogen in Petroleum Products and Lubricants" or ASTM D 4808, "Standard Test Methods for Hydrogen Content of Light Distillates, Middle Distillates, Gas Oils, and Residua by Low-Resolution Nuclear Magnetic Resonance Spectroscopy." For present purposes, hydrogenating can be defined as any process which increases hydrogen content of the steam cracked tar feed. Such processes can include hydrofining, hydrotreating, and hydrocracking, with hydrotreating especially preferred.

In one embodiment of this aspect, the hydrogenating can be carried out in a fixed bed resid hydrotreater that provides hydrotreater bottoms. The hydrotreater can be a downward flow fixed bed resid hydrotreater.

In another embodiment of this aspect of the invention, the process further comprises: i) directing hydrotreater bottoms to a hot separator wherein gaseous hydrogen and hydrogenated steam cracked tar are separated from the hydrotreater bottoms; ii) separating gaseous hydrogen from the hydrogenated steam cracked tar; iii) recycling at least a portion of the gaseous hydrogen to the hydrogenation zone; and iv) condensing the separated hydrogenated steam cracked tar to provide a steam cracking feed. The process can further comprise: v) convection heating the steam cracking feed in a convection section; vi) flashing at least a portion of the convection heated steam cracking feed in a flash zone to provide a tar-lean overheads fraction and a tar-rich bottoms fraction; vii) heating at least a portion of the tar-lean overheads fraction in the convection section; and viii) steam cracking the heated convection section effluent in the radiant section to provide a hot gaseous steam cracker effluent. The process can further comprise separating the hot gaseous steam cracker effluent into at least one olefins-rich steam cracker product stream and a steam cracker tar-rich bottoms stream. At least a portion of the steam cracker tar-rich bottoms stream from the flash zone can be used as the steam cracked tar feed.

In another embodiment, the process further comprises collecting the tar-rich bottoms fraction from the flash zone as a low sulfur fuel oil containing less than about 2 wt. % sulfur. Sulfur content can be measured by any suitable process, e.g., as set out in ASTM D 2622, "Standard Test Method for Sulfur in Petroleum Products by Wavelength Dispersive X-ray Fluorescence Spectrometry" or ASTM D 4294, "Standard Test Method for Sulfur in Petroleum and Petroleum Products by Energy-Dispersive X-Ray Fluorescence Spectrometry."

In yet another embodiment, the flash zone of the process comprises a flash drum external to the steam cracking furnace.

In still another embodiment of this aspect, the flash zone of the process is integral to the steam cracking furnace.

In another aspect, the present invention relates to an apparatus for cracking steam cracker tar feed, which comprises: A) a depolymerizing zone for heating a steam cracked tar feed to provide a depolymerized steam cracked tar containing lower boiling molecules than the steam cracked tar feed, comprising an inlet for receiving steam cracked tar feed, and an outlet for removing depolymerized steam cracked tar; B) a hydrogenating zone comprising an inlet for receiving depolymerized steam cracked tar, a hydrogen gas inlet, a fixed bed of hydrogenating catalyst, and an outlet for removing a mixture comprising hydrogen gas and a hydrogenated steam cracked tar; and C) a steam cracking furnace for cracking at least a portion of the hydrogenated steam cracked tar comprising an inlet for receiving hydrogenated steam cracked tar, a steam inlet, at least one convection zone for heating hydrogenated steam cracked tar, a radiant zone for steam cracking and an outlet for removing hot gaseous steam cracker effluent. The hydrogenating zone typically comprises a fixed bed resid hydrotreater, e.g., a downward flow fixed bed resid hydrotreater.

In an embodiment of this aspect of the invention, the apparatus further comprises: D) a stabilizing zone within A) and wherein A) further comprises an inlet for introducing a hydrogen donor to react with the depolymerized steam cracked tar to provide a stabilized depolymerized steam cracked tar mixture containing i) stable intermediates, ii) gaseous products, and iii) coke. The stable intermediates are typically liquid, particularly under the conditions encountered in the stabilizing zone.

In one embodiment of this aspect, the apparatus can further comprise at least one of: E) a separating zone between D) and B) which comprises an inlet for a stabilized depolymerized steam cracked tar mixture containing i) stable intermediates, ii) gaseous products, and iii) coke, and an outlet for removing a stabilized depolymerized steam cracked tar-rich stream for introduction to the hydrogenating zone; and F) a fractionating zone located between B) and C) for fractionating hydrogenated steam cracked tar comprising an inlet for receiving hydrogenated steam cracked tar, an outlet for removing a bottoms fraction, and at least one outlet for directing to C) at least one lighter fraction, relative to the bottoms fraction.

In another embodiment of this aspect of the invention, the apparatus further comprises at least one of: G) a hot separator zone located between B) and C) comprising an inlet for receiving a mixture comprising unconverted liquid from the hydrogenating zone, gaseous hydrogen and hydrogenated steam cracked tar, an outlet for recycling at least a portion of the unconverted liquid to the hydrogenating zone, and an outlet for removing a mixture rich in gaseous hydrogen and hydrogenated steam cracked tar; H) a gas separating zone comprising an inlet for receiving the mixture rich in gaseous hydrogen and hydrogenated steam cracked tar, an outlet for removing a stream rich in gaseous hydrogen, and an outlet for removing a mixture rich in gaseous hydrogenated steam cracked tar; I) a recycle line for directing at least a portion of the stream rich in gaseous hydrogen to the hydrogenating zone; J) a condensing zone for condensing the gaseous hydrogenated steam cracked tar comprising an inlet for receiving the gaseous hydrogenated steam cracked tar and an outlet for removing condensed hydrogenated steam cracked tar cracking feed; K) a convection zone in the steam cracking furnace for convection heating condensed steam cracked tar cracking feed comprising an inlet for receiving condensed steam cracked tar cracking feed and an outlet for removing convection heated steam cracked tar cracking feed; L) a flashing zone for flashing at least a portion of the convection heated steam cracked tar cracking feed comprising an inlet for receiving convection heated steam cracked tar cracking feed, a bottoms outlet for removing an asphaltene tar-rich bottoms fraction, and an overheads outlet for removing a tar-lean overheads fraction; and M) a convection zone in the steam cracking furnace, downstream of the flashing zone, for convection heating at least a portion of the tar-lean overheads fraction comprising an inlet for receiving the tar-lean overheads fraction and an outlet for removing convection heated tar-lean overheads fraction. The flashing zone L) can comprise a flash drum external to the steam cracking zone. Alternately, the flashing zone L) can comprise a flash drum integral to the steam cracking zone. For present purposes, the term "unconverted liquid" is considered to include liquids taken from the hydrogenating zone that contain less than completely saturated (or hydrogenated) liquids, i.e., partially saturated liquid products.

In yet another embodiment of this aspect of the invention apparatus, the radiant zone of the steam cracking zone C) comprises an inlet for receiving at least a portion of the convection heated tar-lean overheads fraction.

In still another embodiment, the invention apparatus further comprises at least one of N) a fractionator for fractionating the hot gaseous steam cracker effluent which comprises an inlet for receiving the hot gaseous steam cracker effluent, at least one outlet for at least one olefins-rich steam cracker product stream and a bottoms outlet for a steam cracker tar-rich bottoms stream; and O) a line for directing at least a portion of the steam cracker tar-rich bottoms stream of N) to the inlet of depolymerizing zone A).

DETAILED DESCRIPTION OF THE INVENTION

Figure 1:
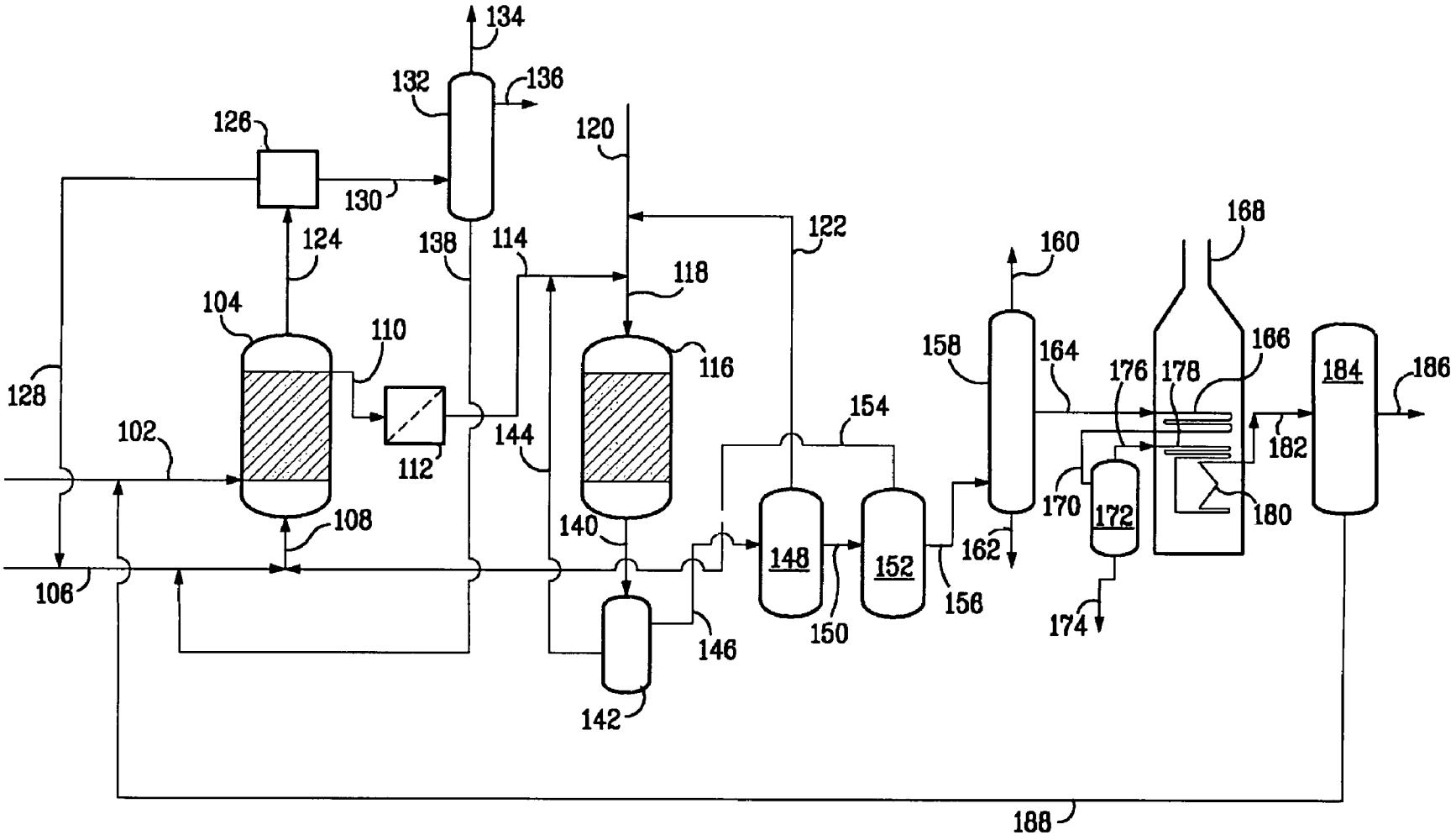
FIG. 1 depicts a process schematic and apparatus for treating steam cracker tar by visbreaking and hydrogenation to provide a suitable feed for a steam cracking plant to produce olefins, in accordance with the present invention.

Unless otherwise stated, all percentages, parts, ratios, etc. are by weight. Ordinarily, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

Steam Cracking

Suitable hydrocarbonaceous feeds which can be steam cracked to provide steam cracked tar feed that is to be treated according to the present invention include naphtha boiling range materials, as well as those boiling with a final boiling point in a temperature range from above about 180° C., such as feeds heavier than naphtha. Such feeds include those boiling in the range from about 93° C. to about 649° C. (from about 200° F. to about 1200° F.), say, from about 204° C. to about 510° C. (from about 400° F. to about 950° F.). Typical heavier than naphtha feeds can include heavy condensates, gas oils, kerosene, hydrocrackates, low sulfur waxy residue, crude, vacuum resid, hydrotreated atmospheric resid, hydrotreated vacuum resid, hydrotreated crude, crude oils, and/or crude oil fractions. Such feeds can include heavier, lower cost streams that include higher sulfur content (greater than about 1 wt. %) and higher TAN (Total Acid Number) (greater than about 0.5). Such feeds can produce relatively large volumes of steam cracked tar as a by-product of steam cracking, which by-product has limited commercial uses. Accordingly, it would be desirable to provide a process which would permit the use of surplus steam cracked products as feeds to the steam cracker itself, e.g., by increasing hydrogen content of the surplus steam cracked products.

The hydrocarbonaceous feeds can comprise a large portion, such as from about 5% to about 50%, of relatively high-boiling components, i.e., resid. Such feeds could comprise, by way of non-limiting examples, one or more of steam cracked gas oils and residues, gas oils, heating oil, jet fuel, diesel, kerosene, gasoline, catalytically cracked naphtha, hydrocrackate, reformate, raffinate reformate, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/ residue admixture, naphtha/residue admixture, hydrocarbon gases/residue admixture, hydrogen/residue admixtures, gas oil/residue admixture, and crude oil. Suitable whole crude oils include those containing high levels of nickel and vanadium such as found in Venezuela tars, for example. Solvent deasphalted (or deasphaltened) (SDA) fractions with and without resins, are especially suited for use as feedstocks in the present invention. The foregoing hydrocarbonaceous feeds can have a nominal end boiling point of at least about 315° C. (600° F.), generally greater than about 510° C. (950° F.), typically greater than about 590° C. (1100° F.), for example, greater than about 760° C. (1400° F.).

Asphaltenes in steam cracked tar can be determined quantitatively as the insolubles in paraffinic solvents. Steam cracked asphaltenes generally are composed of carbon, hydrogen, nitrogen, sulfur with a C:H atomic ratio of about 2.0-1.0 and average molecular weight of about 1000. They are brownish solids having a vaporization/decomposition temperature starting at about 350° C. to about 400° C. as determined by thermogravimetric analysis in nitrogen (heating rate 10° C./minute).

Among the wide range of paraffin insolubles which are formed upon heating and oxidation, the pentane-insolubles and heptane-insolubles, hereinafter designated as $C_5$-asphaltenes and $C_7$-asphaltenes, are of particular interest. Asphaltenes may be specified with reference to the particular paraffins in which they are insoluble, e.g., n-heptane, n-hexane, n-pentane, isopentane, petroleum ether, etc. For present purposes, asphaltene content of a sample can be determined by well-known analytic techniques, e.g., ASTM D6560 (Standard Test for Determination of Asphaltenes (Heptane Insolubles) in Crude Petroleum and Petroleum Products), ASTM D3270 (Standard Test Method for n-Heptane Insolubles), ASTM D4055-02 Standard Test Method for Pentane Insolubles by Membrane Filtration, and ASTM D-893, Standard Test Method for Insolubles in Used Lubricating Oils.

The hydrocarbonaceous feed may be initially heated by indirect contact with flue gas in a convection section tube bank of the pyrolysis furnace (or cracking furnace) before mixing with a dilution fluid, e.g., steam. Preferably, the temperature of the heavy hydrocarbonaceous feedstock is from about 149° C. to about 260° C. (300° F. to 500° F.) before mixing with the dilution fluid, preferably water and steam.

Following mixing with the primary dilution steam stream, the mixture stream may be heated by indirect contact with flue gas in a first convection section of the pyrolysis furnace before being flashed. Preferably, the first convection section is arranged to add the primary dilution steam stream, between subsections of that section such that the hydrocarbonaceous feeds can be heated before mixing with the fluid and the mixture stream can be further heated before being flashed.

The temperature of the flue gas entering the first convection section tube bank is generally less than about 816° C. (1500° F.), for example, less than about 704° C. (1300° F.), such as less than about 621° C. (1150° F.), and preferably less than about 538° C. (1000° F.).

Dilution steam may be added at any point in the process, for example, it may be added to the hydrocarbon feedstock before or after heating, to the mixture stream, and/or to the vapor phase. Any dilution steam stream may comprise sour steam. Dilution steam stream may be heated or superheated in a convection section tube bank located anywhere within the convection section of the furnace, preferably in the first or second tube bank.

The mixture stream may be at about 316° C. to about 538° C. (600° F. to 1000° F.) before introduction to an optional vapor/liquid separator or flash apparatus, located internally within or externally to the steam cracking furnace, e.g., a knockout drum, or flash drum, situated between portions of the convection section, say, between convection section tube banks, or between the convection section and the radiant section of the furnace. The flash pressure can be any suitable pressure, e.g., about 40 to about 200 psia (275 to 1375 kPa). Following the flash, 50% to 98% of the mixture stream can be in the vapor phase. The vapor phase can be heated above the flash temperature before entering the radiant section of the furnace, for example, to about 427° C. to about 704° C. (800° F. to 1300° F.). This heating may occur in a convection section tube bank, preferably the tube bank nearest the radiant section of the furnace, in the lower convection zone.

The temperature of the gaseous effluent at the outlet from the radiant section of the pyrolysis reactor is normally in the range of from about 760° C. to about 929° C. (1400° F. to 1705° F.). The hot gaseous effluent is cooled by a suitable heat exchange means, e.g., a transfer line exchanger and/or supplemental heat exchanger to a temperature below 300° C. (572° F.), e.g., a temperature below 280° C. (536° F.), or even below 270° C. (518° F.).

The resulting cooled cracked effluent can be directed to a suitable separation means such as a tar knockout drum prior to further processing in a separation zone. The flash pressure utilized can be any suitable pressure, e.g., from about 15 to about 200 psia (101 to 1375 kPa). The overhead of the tar knockout drum, containing molecules having boiling points less than about 300° C. (572° F.), can be directed to a separation means for further processing, e.g., to a primary fractionator. The bottoms containing tar can be disposed of or directed to a suitable separation means for further processing, e.g., to a primary fractionator. In the present invention, the bottoms containing tar from the tar knockout drum can themselves be used as at least a portion of the steam cracked tar which is treated by heating and hydrogenation to provide a steam cracker feed. Typically, such bottoms, prior to hydrogenation treatment in accordance with the invention contain less than 13 wt. % hydrogen, preferably less than 11 wt. % hydrogen, as measured by ASTM D 4808. The hydrogenation treatment typically provides a steam cracker feed of greater than 11 wt. % hydrogen, preferably greater than 13 wt. % hydrogen.

The cooled, cracked effluent from the heat exchange means downstream of the pyrolysis reactor can be directly taken to a separation zone (bypassing the tar knockout drum, if present). The separation zone can comprise one or more fractionators, one or more extractors, one or more membranes, or combinations thereof. Preferably, the separation zone comprises a primary fractionator. The separation zone divides the stream into one or more lighter cuts, e.g., steam cracked naphtha boiling in a range from about 10° C. to about 250° C. (50° F. to about 482° F.), say, from about 25° C. to about 210° C. (77° F. to about 410° F.), and steam cracked gas oil, boiling in a range from about 200° C. to about 300° C. (392° F. to about 572° F.), say, from about 210° C. to about 295° C. (410° F. to about 563° F.), as well as a heavy steam cracked tar-rich fraction, typically boiling above about 300° C. (572° F.). This steam cracked tar-rich fraction is utilized as a source of steam cracker feed in accordance with the present invention by heating (visbreaking/depolymerization) and hydrogenation in accordance with the present invention to provide a steam cracker feed which is not constrained by excessive production of steam cracked naphtha, steam cracked tar, and fuel oil by steam cracking.

Visbreaking of Steam Cracked Tar

The resulting steam cracked tar-rich fraction can be collected, typically at a temperature below 300° C. (572° F.), e.g., a temperature below 280° C. (536° F.), or even below 270° C. (518° F.). This cooled steam cracked tar is then treated in accordance with the present invention by heating to effect visbreaking in the presence or absence of hydrogen with or without a free radical acceptor or hydrogen donor, followed by hydrogenation, e.g., by high conversion hydrogenation, say, hydrotreating or hydrocracking, to provide a feed to a steam cracker.

The visbreaking step substantially reduces or eliminates tar asphaltenes or polymers present in steam cracker tar that tend to foul the hydrogenation catalyst. This steam cracker feed provided by the process of the present invention can have at least one of a Conradson carbon number of at least about 4, say, between about 4 and about 40, a total acid number TAN of greater than about 0.5, say, greater than about 1, a sulfur content ranging from 0 wt. % to about 2 wt. %, a hydrogen content of less than about 11 wt. %, say, less than about 11 wt. %, with a substantial amount of feed, say, at least about 80 vol. %, boiling at above 540° F. The feed can be mixed with lower boiling material, e.g., gas oil and can be mixed with hydrogen or another non-oxidizing gas, if necessary. Gas oil or the like acts as a solvent for the tar and permits easy pumping at moderate temperatures and prevents coking at hot spots in the system. The feed is then passed into the bottom of a depolymerizer or visbreaker vessel where the mixture is maintained at a temperature of from about 371° C. to about 482° C. (700° F. to 900° F.), say, from about 399° C. to about 410° C. (750° F. to 770° F.) and under sufficient pressure to maintain it substantially or completely in the liquid phase, say, from about 450 to about 7000 kPa (65 to 1015 psia). The resulting depolymerized tar can contain reactive styrene olefinic bonds or free radicals formed by depolymerization, which streams can benefit by additional treatment, e.g. by treatment with hydrogen donor modifiers to further stabilize the tar. For present purposes, "depolymerized steam cracked tar" describes a steam cracked tar feed containing polymer components which feed has been treated to at least partially reduce the extent of polymerization of at least some of the polymer components. The initial polymers can be converted by depolymerization to lower molecular weight polymers, typically by removal of at least one monomer. Such treatment can also include more extensive depolymerization to form oligomers, dimers, or even monomers. Such conversion can be evidenced by a reduced initial boiling point of the depolymerized steam cracked tar compared to the initial boiling point of the steam cracked tar feed, resulting from the formation of lower molecular weight components.

Stabilizing Steam Cracked Tar or Depolymerized Steam Cracked Tar

A hydrogen donor suitable for stabilizing depolymerized tar, typically an organic hydrogen donor, e.g., a free-radical acceptor or modifier, preferably an acyclic hydrocarbon. Such a hydrocarbon can be a paraffin or iso-paraffin of 4 to 20 carbon atoms per molecule, or an olefin or iso-olefin of 2 to 20 carbon atoms per molecule or mixtures thereof. The hydrogen donor can be optionally added to the steam cracked tar either during or after depolymerizing or visbreaking. Preferably, the hydrogen donor is selected from the group consisting of wild naphtha, naphthenic naphtha, isoparaffinic naphtha, and hydrotreated gas oil. Wild naphtha, obtained as unstabilized naphtha condensate or refinery naphtha boiling from about 50° F. to about 300° F. (10° C. to 149° C.), is particularly suited for use as a hydrogen donor stream. Moreover, hydrotreated gas oil, including fractions of the hydrogenating step of the present invention can be utilized as a hydrogen donor stream for the present invention, if desired. A suitable naphthenic naphtha can be further described as a naphtha boiling range product containing >20 wt. % naphthenes. A suitable isoparaffinic naphtha can be further described as a naphtha boiling range product containing >20 wt. % isoparaffins.

The hydrogen donor can be added in amounts of about 1 to about 25 wt. % based on tar feed and can be sprayed, jetted, or otherwise passed through the liquid tar phase in the visbreaker/depolymerizer, into the vapor phase and removed as overhead. The residence time of the hydrogen donor can typically range from about 5 minutes to one hour. The presence of the hydrogen donors at such short residence times can result in reduced coking and reduced gas loss. However, some of the modifier is consumed in the process. Where n-heptane is the hydrogen donor, the degradation products are predominantly normal hydrocarbons, namely, n-butane, n-pentane, n-hexane, etc., whereas when iso-octane is used the degradation products are predominantly branched, i.e., isobutane, isopentane and branched $C_6$ and $C_7$ paraffins. The hydrogen donor is believed to be consumed with accompanying hydrogen exchange, demethanation, alkylation, isomerization, aromatic disproportionation, among other hydrocarbon reactions. Without intending to limit the invention to any theory of what occurs, the most plausible explanation is a free-radical mechanism in which the condensed ring aromatic components of the tar depolymerize with the formation of free radicals which attach themselves to the hydrogen donor as a "sink." In doing so, the modifier in turn forms free radicals involving stepwise degradation and rearrangement reactions leading to gaseous products, coke, etc. The resulting stabilized product is particularly suited as a feed to the hydrogenation reactor or improved fuel oil.

From the above it appears that the conditions of short residence times for the hydrogen donor or modifier (less than one hour) coupled with fairly long residence times for the tar feed during depolymerization or visbreaking (one to six hours) would provide acceptable results.

The hydrogen donor or modifier, e.g., wild naphtha, can be taken as overhead from the visbreaker vessel and recovered as desired, e.g., by a condenser, and recycled to the hydrogen donor supply. The condenser can also provide a higher boiling stream than naphtha which can be directed to a separation zone, e.g., a fractionator that provides low boiling product and whose bottoms can be combined with the hydrogen donor stream to the visbreaker.

The liquid phase from the depolymerizer/visbreaker can be taken as a sidestream from the depolymerizer/visbreaker and passed through a filter to collect solids, e.g., coke, and thence to the hydrogenation zone, e.g., resid hydrotreater.

Hydrogenation

The depolymerized tar from the visbreaker or the stabilized, depolymerized tar can be fed, preferably without cooling, directly into a suitable hydrogenating vessel. Such a vessel can be selected from traditional fixed bed hydrogenation reactors, such as those used for hydrocracking, hydrotreating, and hydrofining. Especially preferred are hydrotreaters, e.g., a resid hydrotreater, especially a downward flow fixed bed resid hydrotreater, e.g., of the type commercially available from Axens North America, Inc. of Houston, Tex., USA, or Chevron Lummus Global, LLC. Fresh hydrogen and/or recycle hydrogen is introduced to the reactor. Catalyst and conditions in the hydrogenating vessel are maintained so as to provide high conversion levels, typically at least about 5 wt. %, say, from about 5 wt. % to 40 wt. %. The tar flows downwardly through the reactor filled with a suitable contact material such as silica-alumina, alumina or a steam-treated crystalline zeolite, such as faujasite, having a suitable catalyst dispersed thereon. Broadly, the zeolites used are those having silica-to-alumina mole ratios above about 3, preferably 4 to 5.5. Suitable catalysts include noble or non-noble elements and can include platinum on faujasite and/or palladium on faujasite. The non-noble catalysts used are the sulfides of metals Group I-B, II-B, and VIII of the Periodic Table (Handbook of Chemistry and Physics, 38th edition, Chemical Rubber Publishing Company) mixed with the sulfides of non-noble metals from Groups IV, V-B, and VI-B. The preferred metals from the first-named groups are molybdenum and tungsten. Details on the preparation of these catalysts may be found in U.S. Pat. No. 3,549,518. Especially suitable are catalysts that maximize aromatic saturation, e.g., NiCo or NiMo resid hydrotreating catalysts.

The conversion in the hydrogenation reaction zone is maintained at 5%-40% by controlling the conditions therein. Temperatures may range between about 260° C. and about 482° C. (500° F. and 900° F.), preferably between about 371° C. and 427° C. (700° F. and 800° F.). The pressure will range between about 2860 and about 20800 kPa (415 and 3015 psia), preferably between about 3550 and about 10450 kPa (515 and 1515 psia). The space velocity should range from about 0.5 to about 5 v/v/hr, preferably about 3 to about 4.5 v/v/hr and the exit hydrogen rate from about 84 to about 840 normal $m^3/m^3$ (500 to 5000 scfb), preferably about 125 to about 340 normal $m^3/m^3$ (750 to 2000 scfb). Cracked products are removed from the bottom of the reactor and are taken to a hot separator from which liquid products, e.g., 343° C.+(650° F.+) products can be recycled to the hydrogenation reaction zone. Vapors from the hot separator are passed to a condenser and thence to a gas separator from which uncondensed gas, mostly hydrogen, is recycled to the hydrogenation zone. A condenser receives the liquid from the gas separator. The hydrogen donor stream, e.g., wild naphtha modifier, an unstabilized naphtha, may also be provided as condensate by the condenser. The effluent from the condenser is passed either directly to the convection section of the steam cracking furnace, or alternately, directed to an intermediate fractionator which provides an overhead stream to the convection section of the steam cracking furnace, and a bottoms stream which can be directed to fuel oil.

Steam Cracking of Steam Cracker Tar-Derived Feed

As earlier noted, the resulting stream from the above process can be used as the feed to the steam cracking process described in the "Steam Cracking" section above. The process is especially useful where vapor/liquid separator, e.g., an integrated flash drum, is employed to treat feed which has been at least partially heated in the condenser. The resulting bottoms produced by the separator can be utilized as a high quality low sulfur vacuum tower bottoms stream, typically having a sulfur content of less than about 2 wt. % sulfur, preferably less than about 1 wt. % sulfur, e.g., as measured by ASTM D 2622.

In an embodiment of the present invention depicted in FIG. 1, a steam cracker tar feed stream 102 is directed to visbreaker (or depolymerizer) 104 maintained under visbreaking conditions as described above. A hydrogen donor modifier, e.g., wild naphtha, stream 106 is directed to the visbreaker via line 108 to stabilize the depolymerized product. A liquid phase comprising depolymerized, stabilized product is drawn off the visbreaker via line 110 to filter 112, wherein coke is collected and a filtrate is passed via line 114, to a resid hydrotreater 116 via line 118, where the depolymerized product is combined with fresh hydrogen and/or hydrogen recycle from lines 120 and 122, respectively.

Visbreaker overhead is taken via line 124 to condenser 126 whose gas phase is directed via lines 128 and 106 to the hydrogen donor modifier stream line 108. Condensate is taken from condenser 126 via line 130 to fractionator 132 where overhead is taken via line 134, lower boiling products are taken via line 136 and unreacted hydrogen donor and entrained higher boiling components are removed via line 138 to hydrogen donor stream 106.

A hydrotreating catalyst, e.g., a commercial NiCo or NiMo Resid HT catalyst, in the downward flow hydrotreater is processed under hydrotreating conditions as earlier discussed to effect conversion of about 40% for the 538° C.+(1000° F.+) fraction. Hydrogenated products are withdrawn through line 140 to an optional hot separator 142 which can separate a 343° C.+(650° F.+) hydrotreated stream containing unconverted liquids from the hydrogenation zone (hydrotreater) 116 for recycle to the hydrotreater via line 144. Vapors are taken via line 146 from hot separator 142 (or optionally directly from the hydrotreater 116 via line 140, not shown) to a gas separator 148 (optionally via a condenser, not shown) wherein hydrogen and other gaseous products are removed via line 122 for recycle to the hydrotreater 116. A side stream is taken via line 150 to a condenser 152. Overhead from the condenser can be circulated via line 154 as a hydrogen donor stream via line 108 to the visbreaker 104. The liquid phase from the condenser 152 can be directed via line 156 to a fractionator 158 for resolution into an overheads fraction taken via line 160, a high asphaltene bottoms fraction removed via line 162 (that can be further treated by partial oxidation or sent to fuel oil), and a steam cracker feed fraction boiling between 38° C. and 538° C. (100° F. to 1000° F.). This fraction (or alternately the liquid phase from the condenser 152 without passing through a fractionator) can be directed to a steam cracker via line 164 for heating in a convection section 166 of a steam cracker 168.

The heated fraction (or liquid phase from the condenser) is directed via line 170 to a vapor/liquid separator 172 which provides a bottoms fraction via line 174 suitable as a low sulfur vacuum tower bottoms stream. The vapor fraction is passed via line 176 to a downstream convection section 178 and thence to a radiant section 180 for cracking. Hot effluent passes through a transfer line exchanger 182 and thence to a fractionator means or train 184 for resolution into steam cracker products, e.g., lower olefins, via line 186. Steam cracked tar, suitable for use as a feed in the present invention, can be removed as bottoms via line 188 and directed to line 102.

Table I below sets out the respective fractions present in an untreated steam cracked tar suited for use in the present invention.

TABLE I

| Fraction | Tar, wt. % |
|---|---|
| <293° C. | 19 ± 1.1 |
| 293°-566° C. | 47 ± 1.0 |
| >566° C. | 15 ± 0.5 |
| Asphaltenes | 19 ± 0.5 |
| Coke | 0 |

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A process for steam cracking a steam cracked tar that comprises:

a) heating a steam cracked tar feed from below 300° C. to a temperature above 300° C. for a time sufficient to provide a depolymerized steam cracked tar containing lower boiling molecules than the steam cracked tar feed;

b) hydrogenating the depolymerized steam cracked tar with a hydrogenating catalyst in the presence of hydrogen under hydrogenating conditions in a hydrogenation zone to provide a hydrogenated mixture comprising hydrogenated steam cracked tar; and c) steam cracking at least a portion of the hydrogenated steam cracked tar in a steam cracking furnace comprising a convection section and a radiant section.

2. The process of claim 1 which further comprises treating the hydrogenated mixture by at least one of vacuum distillation separation and flash separation to remove a bottoms fraction and provide, from a remaining fraction, a portion of the hydrogenated steam cracked tar to be steam cracked.

3. The process of claim 2 which further comprises:

stabilizing the depolymerized steam cracked tar by contacting with a hydrogen donor to react with reactive styrene olefinic bonds and/or free radicals of the depolymerized steam cracked tar to provide i) stabilized depolymerized steam cracked tar containing stable intermediates and ii) gaseous products.

4. The process of claim 3 which further comprises:

separating the gaseous products from the stabilized depolymerized steam cracked tar prior to the hydrogenating step.

5. The process of claim 4 wherein the gaseous products are separated as an overhead.

6. The process of claim 3 wherein the hydrogen donor is selected from the group consisting of wild naphtha, naphthenic naphtha, isoparaffinic naphtha, and hydrotreated gas oil.

7. The process of claim 1 wherein the steam cracked tar feed is obtained by steam cracking a hydrocarbon feed selected from the group consisting of whole crudes, deasphalted crudes, resids, deasphalted atmospheric resids, condensates, raffinates, naphthas, hydrotreated naphthas, cracked naphthas, virgin gas oils, hydrotreated gas oils, and cracked gas oils.

8. The process of claim 1 wherein a) and b) are carried out in the same vessel.

9. The process of claim 1 wherein the steam cracked tar feed has a hydrogen content of less than 11 wt. % hydrogen, and the hydrogenated steam cracked tar has a hydrogen content of greater than 11 wt. % hydrogen based upon the total weight of the steam cracked tar.

10. The process of claim 1 wherein the hydrogenating is carried out in a fixed bed resid hydrotreater.

11. The process of claim 10 which further comprises: i) directing hydrotreater bottoms to a hot separator wherein gaseous hydrogen and hydrogenated steam cracked tar are separated from the hydrotreater bottoms; ii) separating gaseous hydrogen from the hydrogenated steam cracked tar; iii) recycling at least a portion of the gaseous hydrogen to the hydrogenation zone; and iv) condensing the separated hydrogenated steam cracked tar to provide a steam cracking feed.

12. The process of claim 11 which further comprises: v) convection heating the steam cracking feed in a convection section; vi) flashing at least a portion of the convection heated steam cracking feed in a flash zone to provide a tar-lean overheads fraction and a tar-rich bottoms fraction; vii) heating at least a portion of the tar-lean overheads fraction in the convection section; and viii) steam cracking the heated convection section effluent in the radiant section to provide a hot gaseous steam cracker effluent.

13. The process of claim 12 which further comprises separating the hot gaseous steam cracker effluent into at least one olefins-rich steam cracker product stream and a steam cracker tar-rich bottoms stream.

14. The process of claim 13 wherein at least a portion of the steam cracker tar-rich bottoms stream from the flash zone is used as the steam cracked tar feed.

15. The process of claim 12 which further comprises collecting the tar-rich bottoms fraction from the flash zone as a low sulfur vacuum tower bottoms stream (LSVTB) containing less than about 2 wt. % sulfur.

16. The process of claim 12 wherein the flash zone comprises a flash drum external to the steam cracking furnace.

17. The process of claim 12 wherein the flash zone is integral to the steam cracking furnace.

* * * * *